United States Patent [19]

Bedford

[11] Patent Number: 5,002,256

[45] Date of Patent: Mar. 26, 1991

[54] LIFTING AND SUPPORTING DEVICE

[76] Inventor: Marlin D. Bedford, 924 Mimosa, West Memphis, Ark. 72301

[21] Appl. No.: 522,543

[22] Filed: May 11, 1990

[51] Int. Cl.[5] ..... B66F 5/04

[52] U.S. Cl. ..... 254/2 R; 254/134

[58] Field of Search ..... 254/2 R, 2 B, 2 C, 133, 254/134, 89 R, 89 H, 95, DIG. 4; 269/17; 248/352

[56] References Cited

U.S. PATENT DOCUMENTS

| | | | |
|---|---|---|---|
| 2,369,603 | 2/1945 | Phillips et al. . | |
| 3,949,976 | 4/1976 | Cofer | 254/134 |
| 4,123,038 | 10/1978 | Meyers | 254/2 R |
| 4,177,978 | 12/1979 | Warsaw | 254/2 R |
| 4,700,798 | 10/1987 | Johansson et al. . | |
| 4,793,592 | 12/1988 | Green et al. . | |

FOREIGN PATENT DOCUMENTS

| | | | |
|---|---|---|---|
| 324824 | 11/1956 | Switzerland | 254/134 |

*Primary Examiner*—Robert C. Watson

*Attorney, Agent, or Firm*—Walker & McKenzie

[57] ABSTRACT

A device for lifting and supporting a wheeled vehicle. The device includes jack structure for lifting the vehicle from a lowered position to a raised position; support structure for supporting the vehicle in the raised position; and connecting structure for connecting the support structure to the jack structure and for causing the support structure to move from an unsupported position in which the vehicle is not supported by the support structure to a support position in which the vehicle is supported by the support structure when the jack structure lifts the vehicle from the lowered position to the raised position.

4 Claims, 1 Drawing Sheet

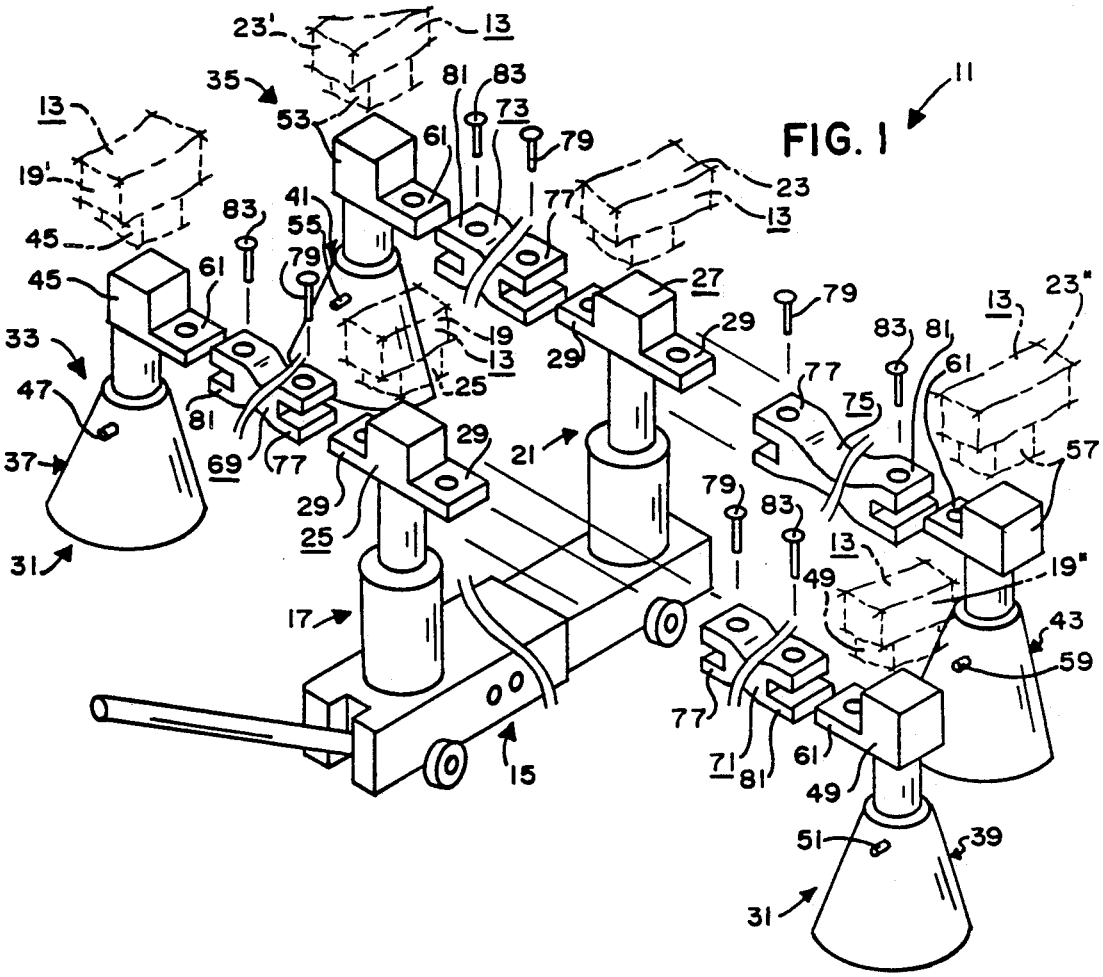
FIG. 1
FIG. 2
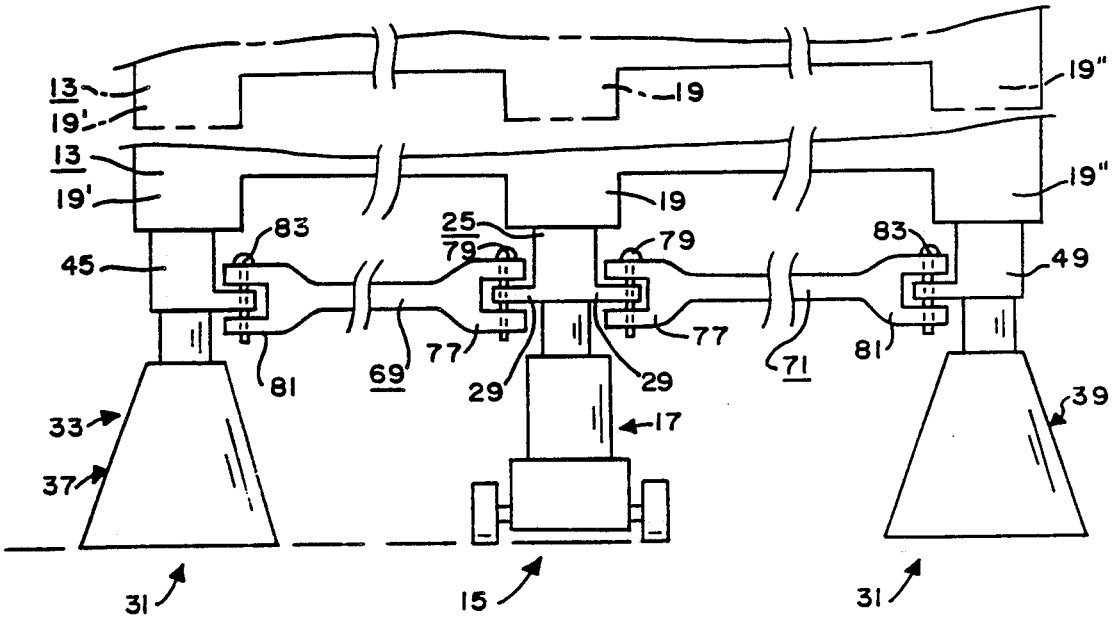

LIFTING AND SUPPORTING DEVICE

BACKGROUND OF THE INVENTION

1. Field of the Invention

The present invention relates, in general, to wheeled vehicle jacks and, more specifically, to a device for lifting and safely supporting a wheeled vehicle.

2. Information Disclosure Statement

Jacks for lifting vehicles and the like come in many different types. Bumper jacks are provided for engaging a portion of a vehicle's bumper to lift the bumper, and thus a portion of the vehicle, off a supporting surface. Frame jacks engage a portion of a vehicle's frame to lift a portion of the frame, and thus a portion of the vehicle, off a supporting surface. Bumper and frame jacks are further divided into screw jacks, hydraulic jacks, etc. However, when using any prior art jack, normal, safe practice requires that the vehicle be supported on one or more jack stand or the like after it has been lifted off the supporting surface and before work is performed beneath it. Such jack stands typically include a stable tripod-type base with a movable head that can be locked in a raised position by a pin or the like.

A preliminary patentability search disclosed Phillips, U.S. Pat. No. 2,369,603; Johansson et al., U.S. Pat No. 4,700,798; and Green et al., U.S. Pat. No. 4,793,592. Phillips discloses a jack for supporting and lifting an aircraft wheel. Johansson et al. discloses a driver training apparatus including a lifting frame for being disposed under a car. Green et al. discloses a mobile jack apparatus including a pair of jacks to provide multiple support points when lifting a vehicle or the like. None of the above patents disclose or suggest the present invention. More specifically, nothing in the above patents disclose or suggest a device for lifting and supporting a wheeled vehicle that includes jack means for lifting the vehicle from a lowered position to a raised position; support means for supporting the vehicle in the raised position; and connecting means for connecting the support means to the jack means and for causing the support means to move from an unsupported position in which the vehicle is not supported by the support means and a support position in which the vehicle is supported by the support means when the jack means lifts the vehicle from the lowered position to the raised position.

SUMMARY OF THE INVENTION

The present invention is directed toward providing an improved device for lifting and stable supporting vehicles. The concept of the present invention is to combine a jack with a jack stand in such a manner so that the jack stand will be moved to proper position automatically when the vehicle is lifted by the jack.

The device of the present invention includes, in general, jack means for lifting a wheeled vehicle from a lowered position to a raised position; support means for supporting the vehicle in the raised position; and connecting means for connecting the support means to the jack means and for causing the support means to move from an unsupported position in which the vehicle is not supported by the support means and a support position in which the vehicle is supported by the support means when the jack means lifts the vehicle from the lowered position to the raised position.

BRIEF DESCRIPTION OF THE DRAWINGS

FIG. 1 is a perspective exploded view of the device of the present invention showing portions of a vehicle in broken lines and showing portions of the device in a moved position in broken lines.

FIG. 2 is an end elevational view of the device of the present invention showing portions of a vehicle in solid and broken lines.

DESCRIPTION OF THE PREFERRED EMBODIMENT

The preferred embodiment of the device 11 of the present invention is used to lift and support a vehicle 13 such as an automobile or the like.

The device 11 includes jack means 15 for lifting the vehicle 13 from a lowered position as shown in solid lines in FIG. 2 to a raised position as shown in broken lines in FIG. 2. The jack means 15 preferably includes a first jack means 17 for lifting a first portion 19 of the vehicle 13 from the lowered to the raised position and preferably includes a second jack means 21 for lifting a second portion 23 of the vehicle 13 from the lowered to the raised position (see, in general, FIG. 1). The first jack means 17 preferably includes a head means 25 for movement between a lowered position as shown in solid lines in FIG. 1 and a raised position as shown in broken lines in FIG. 1. The second jack means 21 preferably includes a head means 27 for movement between a lowered position as shown in solid lines in FIG. 1 and a raised position as shown in broken lines in FIG. 1. The first and second jack means 17, 21 are preferably adjustably coupled to one another to allow the distance between the first and second jack means 17, 21 to be varied. The specific construction of the jack means 15 may vary as will now be apparent to those skilled in the art. Thus, the basic construction of the jack means 15 may be like that taught by Green et.al., U.S. Pat. No. 4,793,592, issued Dec. 27, 1988 and reference should be made to the Green et al. patent for more specific details. The head means 25, 27 are preferably constructed out of metal with outwardly extending ears 29 for reasons which will hereinafter become apparent.

The device 11 includes support means 31 for supporting the vehicle 13 in the raised position. The support means 31 having a lower or unsupported position as shown in solid lines in FIG. 1 in which the vehicle 13 is not supported by the support means 31 and a raised or support position as shown in broken lines in FIG. 1 in which the vehicle 13 is supported by the support means 31. The support means 31 preferably includes a first support means 33 for supporting the first portion 19 of the vehicle 13 in the raised position, and preferably includes a second support means 35 for supporting the second portion 23 of the vehicle 13 in the raised position. The first support means 33 preferably includes a first support member 37 for supporting a first side 19' of the first portion 19 of the vehicle 13 in the raised position, and preferably includes a second support member 39 for supporting a second side 19'' of the first portion 19 of the vehicle 13 in the raised position. The second support means 35 preferably includes a first support member 41 for supporting a first side 23' of the second portion 23 of the vehicle 13 in the raised position, and preferably includes a second support member 43 for supporting a second side 23'' of the second portion 23 of the vehicle 13 in the raised position. The first support member 37 of the first support means 33 preferably includes a head means 45 for movement between a lowered position and a raised position and preferably includes lock means 47 for locking the head means 45 thereof in the raised position. The second support member 39 of the first support means 33 preferably includes a head means 49 for movement between a lowered position and a raised position and preferably includes lock means 51 for locking the head means 49 thereof in the raised position. The first support member 41 of the second support means 35 preferably includes a head means 53 for movement between a lowered position and a raised position and preferably includes lock means 55 for locking the head means 53 thereof in the raised position. The second support member 43 of the second support means 35 preferably includes a head means 57 for movement between a lowered position and a raised position and preferably includes lock means 59 for locking the head means 57 thereof in the raised position. The support members 37, 39, 41, 43 may be constructed in various manners as will now be apparent to those skilled in the art. Preferably, the support members 37, 39, 41, 43 include off-the-shelf type jack stands well known to those skilled in the art for safely supporting an automobile or the like in a raised position. Such jack stands typically include a conical base, a piston slidably mounted on the base, and a pin-type lock for locking the piston in a raised position as will now be apparent to those skilled in the art. The head means 45, 49, 53, 57 are preferably constructed out of metal with outwardly extending ears 61 for reasons which will hereinafter become apparent.

The device 11 includes connecting means for connecting the support means 31 to the jack means 15 and for causing the support means 31 to move from the unsupported position to the support position when the jack means 15 lifts the vehicle 13 from the lowered position to the raised position. The connecting means preferably includes a first connecting means for connecting the first support means 33 to the first jack means 17, and preferably includes a second connecting means for connecting the second support means 35 to the second jack means 21. The first connecting means preferably includes a first arm means 69 for extending between the first jack means 17 and the first support member 37 of the first support means 33, and preferably includes a second arm means 71 for extending between the first jack means 17 and the second support member 39 of the first support means 33. The second connecting means preferably includes a first arm means 73 for extending between the second jack means 21 and the first support member 41 of the second support means 35, and preferably includes a second arm means 75 for extending between the second jack means 21 and the second support member 43 of the second support means 35. Each arm means 69, 71, 73, 75 preferably consists of an elongated, rigid metal bar having a first end 77 for being pivotally attached to an ear 29 of the respective head means 25, 27 of the respective jack means 17, 21 by way of a pivot 79 or the like, and having a second end 81 for being pivotally attached to an ear 61 of the respective head means 45, 49, 53, 57 of the respective support member 37, 39, 41, 43 by way of a pivot 83 or the like.

The operation and use of the preferred embodiment of the device 11 of the present invention is quite simple. The Jack means 15 is merely placed under the vehicle 11 and the location and spacing of the jack means 17, 21 adjusted until the head means 25, 27 are located directly beneath proper jacking areas on the underside of the vehicle 13 as indicated by the manufacturer of the vehicle 13 or the like and as will now be apparent to those skilled in the art. Next, the position of the support members 37, 39, 41, 43 is adjusted by pivoting the arm means 69, 71, 73, 73 relative to the jack means 17, 21 until the head means 45, 49, 53, 57 are located directly beneath proper support areas on the underneath side of the vehicle 13 as indicated by the manufacturer of the vehicle 13 or the like and as will now be apparent to those skilled in the art. Next, with the lock means 47, 51, 55, 59 in unlocked positions, the jack means 15 is activated in a normal manner (e.g., by pumping the handle thereof) to raise the jack means 17, 21 and thus jack up the vehicle 13 as will now be apparent to those skilled in the art. As the jack means 17, 21 are thus raised, the arm means 69, 71, 73, 75 will also be raised and will cause the support members 37, 39, 41, 43 to move to the support position as will now be apparent to those skilled in the art. When the vehicle 13 is jacked to the desired height, the lock means 47, 51, 55, 59 are moved to the lock position, whereby the vehicle 13 will be safely held in the raised position as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A device for lifting and supporting a wheeled vehicle, said device comprising:

(a) jack means for lifting said vehicle from a lowered position to a raised position; said jack means including a first jack means for lifting a first portion of said vehicle from said lowered position to said raised position; said jack means including a second jack means for lifting a second portion of said vehicle from said lowered position to said raised position; said first and second jack means being adjustably coupled to one another to allow the distance between said first and second jack means to be varied; said first jack means including a head means for movement between a lowered position and a raised position; said second jack means including a head means for movement between a lowered position and a raised position;

(b) support means for supporting said vehicle in said raised position; said support means having an unsupported position in which said vehicle is not supported by said support means and a support position in which said vehicle is supported by said support means; said support means including a first support means for supporting said first portion of said vehicle in said raised position; said support means including a second support means for supporting said second portion of said vehicle in said raised position; said first support means including a first support member for supporting a first side of said first portion of said vehicle in said raised position; said first support means including a second support member for supporting a second side of said first portion of said vehicle in said raised position; said second support means including a first support member for supporting a first side of said second portion of said vehicle in said raised position; said second support means including a second support member for supporting a second side of said second portion of said vehicle in said raised position; said first support member of said first support means including a head means for movement between a lowered position and a raised position and including lock means for locking said head means thereof in said raised position; said second support member of said first support means including a head means for movement between a lowered position and a raised position and including lock means for locking said head means thereof in said raised position; said first support member of said second support means including a head means for movement between a lowered position and a raised position and including lock means for locking said head means thereof in said raised position; said second support member of said second support means including a head means for movement between a lowered position and a raised position and including lock means for locking said head means thereof in said raised position; and (c) connecting means for connecting said support means to said jack means and for causing said support means to move from said unsupported position to said support position when said jack means lifts said vehicle from said lowered position to said raised position; said connecting means including a first connecting means for connecting said first support means to said first jack means; said connecting means including a second connecting means for connecting said second support means to said second jack means; said first connecting means including a first arm means for extending between said first jack means and said first support member of said first support means; said first connecting means including a second arm means for extending between said first jack means and said second support member of said first support means; said second connecting means including a first arm means for extending between said second jack means and said first support member of said second support means; said second connecting means including a second arm means for extending between said second jack means and said second support member of said second support means; said first arm means of said first connecting means having a first end for being attached to said head means of said first jack means and having a second end for being attached to said head means of said first support member of said first support means; said second arm means of said first connecting means having a first end for being attached to said head means of said first jack means and having a second end for being attached to said head means of said second support member of said first support means; said first arm means of said second connecting means having a first end for being attached to said head means of said second jack means and having a second end for being attached to said head means of said first support member of said second support means; said second arm means of said second connecting means having a first end for being attached to said head means of said second jack means and having a second end for being attached to said head means of said second support member of said second support means; said first arm means of said first connecting means being rigid; said first end of said first arm means of said first connecting means being pivotally attached to said head means of said first jack means; said second end of said first arm means of said first connecting means being pivotally attached to said head means of said first support member of said first support means; said second arm means of said first connecting means being rigid; said first end of said second arm means of said first connecting means being pivotally attached to said head means of said first jack means; said second end of said second arm means of said first connecting means being pivotaly attached to said head means of said second support member of said first support means.

2. The device of claim 1 in which said first arm means of said second connecting means is rigid, in which said first end of said first arm means of said second connecting means is pivotally attached to said head means of said second jack means, and in which said second end of said first arm means of said second connecting means is pivotally attached to said head means of said first support member of said second support means.

3. The device of claim 2 in which said second arm means of said second connecting means is rigid, in which said first end of said second arm means of said second connecting means is pivotally attached to said head means of said second jack means, and in which said second end of said second arm means of said second connecting means is pivotally attached to said head means of said second support member of said second support means.

4. A device for lifting and safely supporting a wheeled vehicle including a front portion having a first side and a second side and including a rear portion having a first side and a second side, said device comprising:

(a) jack means for lifting said vehicle from a lowered position to a raised position; said jack means including a first jack means for lifting said front portion of said vehicle from said lowered position to said raised position; said jack means including a second jack means for lifting said rear portion of said vehicle from said lowered position to said raised position; said first jack means including a head means for movement between a lowered position and a raised position; said second jack means including a head means for movement between a lowered position and a raised position; said first and second jack means being adjustably coupled to one another to allow the distance between said first and second jack means to be varied;

(b) support means for supporting said vehicle in said raised position; said support means having an unsupported position in which said vehicle is not supported by said support means and a support position in which said vehicle is supported by said support means; said support means including a first support means for supporting said front portion of said vehicle in said raised position; said support means including a second support means for supporting said rear portion of said vehicle in said raised position; said first support means including a first support member for supporting said first side of said front portion of said vehicle in said raised position; said first support means including a second support member for supporting said second side of said front portion of said vehicle in said raised position; said second support means including a first support member for supporting said first side of said rear portion of said vehicle in said raised position; said second support means including a second support member for supporting said second side of said rear portion of said vehicle in said raised position; said first support member of said first support means including a head means for movement between a lowered position and a raised position and including look means for locking said head means thereof in said raised position; said second support member of said first support means including a head means for movement between a lowered position and a raised position and including lock means for locking said head means thereof in said raised position; said first support member of said second support means including a head means for movement between a lowered position and a raised position and including lock means for locking said head means thereof in said raised position; said second support member of said second support means including a head means for movement between a lowered position and a raised position and including lock means for locking said head means thereof in said raised position; and (c) connecting means for connecting said support means to said jack means and for causing said support means to move from said unsupported position to said support position when said jack means lifts said vehicle from said lowered position to said raise position; said connecting means including a first connecting means for connecting said first support means to said first jack means; said connecting means including a second connecting means for connecting said second support means to said second jack means; said first connecting means including a rigid first arm means for extending between said first jack means and said first support member of said first support means; said first connecting means including a rigid second arm means for extending between said first jack means and said second support member of said first support means; said second connecting means including a rigid first arm means for extending between said second jack means and said first support member of said second support means; said second connecting means including a rigid second arm means for extending between said second jack means and said second support member of said second support means; said first arm means of said first correcting means having a first end for being pivotally attached to said head means of said first jack means and having a second end for being pivotally attached to said head means of said first support member of said first support means; said second arm means of said first connecting means having a first end for being pivotally attached to said head means of said first jack means and having a second end for being pivotally attached to said head means of said second support member of said first support means; said first arm means of said second connecting means having a first end for being pivotally attached to said head means of said second jack means and having a second end for being pivotally attached to said head means of said first support member of said second support means; said second arm means of said second connecting means having a first end for being pivotally attached to said head means of said second jack means and having a second end for being pivotally attached to said head means of said second support member of said second support means.

* * * * *